US007214124B2

(12) United States Patent
Kobayashi et al.

(10) Patent No.: US 7,214,124 B2
(45) Date of Patent: May 8, 2007

(54) EQUIPMENT AND METHOD FOR POLISHING BOTH SIDES OF A RECTANGULAR SUBSTRATE

(75) Inventors: Kazuo Kobayashi, Annaka (JP); Katsuhiro Tsuji, Yokohama (JP)

(73) Assignee: Okamoto Machine Tool Works Ltd., Annaka (JP)

( * ) Notice: Subject to any disclaimer, the term of this patent is extended or adjusted under 35 U.S.C. 154(b) by 0 days.

(21) Appl. No.: 11/519,833

(22) Filed: Sep. 13, 2006

(65) Prior Publication Data

US 2007/0060027 A1 Mar. 15, 2007

(30) Foreign Application Priority Data

Sep. 14, 2005 (JP) ..... 2005-266231

(51) Int. Cl.
*B24B 1/00* (2006.01)

(52) U.S. Cl. ..... 451/57; 451/36; 451/59; 451/533; 451/550

(58) Field of Classification Search ..... 451/36, 451/41, 42, 57, 59, 60, 63, 65, 533, 534, 451/538, 539, 550; 51/296–300
See application file for complete search history.

(56) References Cited

U.S. PATENT DOCUMENTS

| | | | | |
|---|---|---|---|---|
| 6,287,175 | B1 * | 9/2001 | Marukawa et al. | 451/41 |
| 6,419,567 | B1 * | 7/2002 | Glashauser | 451/259 |
| 6,439,965 | B1 * | 8/2002 | Ichino et al. | 451/36 |
| 6,468,139 | B1 * | 10/2002 | Talieh et al. | 451/296 |
| 6,561,876 | B1 * | 5/2003 | Tateyama et al. | 451/41 |
| 6,875,082 | B2 * | 4/2005 | Nakayama et al. | 451/36 |
| 6,939,204 | B2 * | 9/2005 | Moriya | 451/36 |
| 2003/0181141 | A1 * | 9/2003 | Taniguchi et al. | 451/36 |
| 2005/0007540 | A1 | 1/2005 | Tsuboi et al. | |
| 2005/0130386 | A1 | 6/2005 | Watanabe et al. | |

FOREIGN PATENT DOCUMENTS

| | | |
|---|---|---|
| JP | 6-218667 | 8/1994 |
| JP | 2001-1241 | 1/2001 |
| JP | 2003-48156 | 2/2003 |
| JP | 2003-255291 | 9/2003 |
| JP | 2004-21016 | 1/2004 |
| JP | 2004-122351 | 4/2004 |
| JP | 2005-3845 | 1/2005 |

* cited by examiner

*Primary Examiner*—Lee D. Wilson
*Assistant Examiner*—Anthony Ojini
(74) *Attorney, Agent, or Firm*—Oblon, Spivak, McClelland, Maier & Neustadt, P.C.

(57) ABSTRACT

Double-sided polishing equipment configured to polish a rectangular substrate, comprising a carrier having a pocket configured to accommodate a rectangular substrate, a lateral linear moving mechanism configured to move the carrier, first and second polishing pads with first and second rotational axes, respectively, offset from centers of the pads, the polishing surfaces of the first and second polishing pads being parallel. The equipment further includes at least one elevating mechanism coupled to at least one of the polishing pads, first and second rotary drive mechanisms coupled to each of the first and second polishing pads, respectively; and configured to rotate the first and second pads about the first and second rotational axes. A polishing-agent supplying device is present and configured to supply polishing agent to a plane where a substrate that is accommodated in the pocket to accommodate the substrate comes into contact with the polishing pads.

20 Claims, 4 Drawing Sheets

EQUIPMENT AND METHOD FOR POLISHING BOTH SIDES OF A RECTANGULAR SUBSTRATE

CROSS-REFERENCE TO RELATED APPLICATIONS

The following application claims priority to Japanese Patent Application No. 2005-266231 filed on Sep. 14, 2005, the entire contents of which are hereby incorporated by reference herein.

BACKGROUND OF THE INVENTION

1. Field of the Invention

The present invention relates to equipment for polishing both sides of a rectangular substrate, such as a glass substrate, a quartz substrate, a sapphire substrate, a GaAs substrate, or a silicon substrate, etc., simultaneously in order to planarize the substrate and reduce the thickness thereof, and a method to planarize both sides of the rectangular substrate. In particular, the double-sided polishing equipment for the rectangular substrate is typically used to polish both sides of a glass plate for LCD devices, between which liquid crystal is injected, a glass laminate for a flat panel display, or a glass substrate for a display device, within which electrodes are provided and between which liquid crystal is injected.

2. Description of the Related Art

Glass plate for LCD devices, between which liquid crystal is injected, or glass substrates for display devices, within which electrodes are provided and between which liquid crystal is injected, are known and used for LCD panels. (For example, see Japanese Unexamined Patent Application Publication 2003-255291, Japanese Unexamined Patent Application Publication 2004-21016, and Japanese Unexamined Patent Application Publication 2005-3845.)

Typically, the thickness of rectangular glass plate used for such LCD panels is reduced by grinding the surface or using a lapping process. Furthermore, its ground or lapped surface is planarized by an etching process or a polishing process performed on each side or on both sides at the same time.

Either a method of polishing both sides of the rectangular glass plate with polishing pads at the same time, or a method of separately polishing each side can be used. The double-sided polishing method has a carrier main body forming a gear part around the periphery and provides a pocket about the size and shape of the rectangular glass plate. The carrier main body has a supporting member placed between the flat edge of the rectangular glass plate and the perimeter part of the pocket provided in the carrier main body. The carrier main body is made from a high rigid material. Further, the carrier is typically made of a flexible material that is not prone to damaging the rectangular glass plate at least when the contact site of the supporting member of the glass plate with the rectangular glass plate is brought into contact with the rectangular glass plate. When the rectangular glass plate is supported by the carrier, a driving mechanism for the double-sided polishing equipment will rotate the carrier by means of a gear part on the carrier main body to rub both sides of the rectangular glass with a pair of round polishing pads that are coaxial in order to polish both sides of the rectangular glass plate. (For example, see Japanese Unexamined Patent Application Publication H6-218667.)

As a method of polishing LCD devices, another manufacturing method is suggested in which a spacer member is provided on one glass substrate on which a driver for driving liquid crystals is to be fitted so as to polish liquid crystal cells after the processing vertical and horizontal dimensions of liquid crystal cells. A pair of rectangular glass substrates in a product size are rubbed with a pair of round polishing pads provided coaxially at centers of axes of the polishing heads on both sides of the liquid crystal cell (rectangular glass plate) in order to make the liquid crystal cell thinner. (For example, see Japanese Unexamined Patent Application Publication 2003-255291.)

As a method of polishing each side of a large rectangular glass plate with the polishing pad, a polishing method for a rectangular glass plate is suggested, including a process of putting a rectangular glass plate into a film frame where the film on which a rectangular glass plate can be applied is applied. The method includes attaching the frame to the carrier or a process of attaching the film frame where the film on which a rectangular glass plate can be applied is applied onto the carrier. The method further includes applying the rectangular glass plate onto the film frame and a process of polishing by moving the carrier on which the film frame is attached and the polishing pad closer to each other. The method further includes pressing the surface to be polished of the rectangular glass plate applied on the film onto the polishing pads, and a process of, after polishing the rectangular glass plate, removing the film frame from the carrier and then the rectangular glass plate from the film frame or a process of, after polishing the rectangular glass plate, removing the rectangular glass plate from the film frame and then the film frame from the carrier. (For example, see Japanese Unexamined Patent Application Publication 2004-122351.)

The method of polishing each side of a rectangular glass plate has the advantage that the rectangular glass plate hardly deviates from the polishing equipment during polishing. However, polishing each side separately requires more polishing-process stages as well as a procedure to turn over the rectangular glass plate halfway through the process, so polishing equipment becomes more bulky than double-sided polishing equipment that can polish both sides of a rectangular glass plate at the same time. In other words, single-sided polishing equipment requires a big footprint, which is a disadvantage.

Although double-sided polishing equipment has the advantage of shorter polishing time than is necessary for the method of polishing each side separately, there is a concern that, while polishing, the rectangular glass plate within the carrier may deviate from the polishing equipment if the substrate is thin, with differences in thickness of up to 1 mm.

SUMMARY OF THE INVENTION

The inventors of the present invention observed the principle of movement made in shaping a cake of rice with both hands into a triangular shape to make Japanese-style rice balls known as 'O-musubi.' They realized that each hand at the upper and lower positions moves in opposite directions from each other, the rotation axes of both hands is not aligned, and both hands swing slightly laterally, which enables, to a great extent, the rice cake between the hands to form a triangular shape. Such movements are applied to the polishing pads of the double-sided polishing equipment for the rectangular glass plate, and the movement of the rice ball is applied to that of the carrier to construct the present invention.

One aspect of the invention includes a double-sided polishing equipment configured to polish a rectangular substrate. The equipment includes a carrier having a pocket configured to accommodate a rectangular substrate, a lateral linear moving mechanism configured to move the carrier, first and second polishing pads with first and second offset rotational axes, respectively, the first and second offset rotational axes being offset from each other and from centers of the polishing pads. The polishing surfaces of the first and second polishing pads are parallel. This aspect further includes an elevating mechanism coupled to at least one of the polishing pads, first and second rotary drive mechanisms coupled to each of the first and second polishing pads, respectively, and configured to rotate the first and second polishing pads about the first and second offset rotational axes, respectively; and a polishing agent supplying device configured to supply polishing agent to a plane where a rectangular substrate that is accommodated in the pocket to accommodate the rectangular substrate comes into contact with the polishing pads.

Another aspect of the present invention is to provide a method of polishing two sides of a rectangular substrate simultaneously, including holding the rectangular substrate within a pocket of a carrier, passing the substrate between a pair of polishing pads with parallel polishing surfaces rotating in opposite directions on offset axes of rotation so as to polish two sides of the substrate, the offset axes of rotation being offset from each other and from centers of the polishing pads. This aspect further includes keeping the rectangular substrate on the polishing pads for a certain length of time and oscillating the carrier laterally and intermittently while polishing the rectangular substrate.

Both sides of the rectangular substrate are polished using eccentric rectangular polishing pads that, while oscillating the rectangular substrate laterally, rotate in opposite directions from each other, so the difference in thickness between the four corners and other areas of the polished rectangular substrate becomes smaller. In other words, a rectangular substrate that is improved in consistency of thickness can be obtained. In addition, a pair of eccentric rectangular polishing pads, the centers of rotational axes of which are remotely spaced from each other, rotate in opposite directions from each other, so a thin rectangular substrate will not deviate from the pocket of the carrier while being polished.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
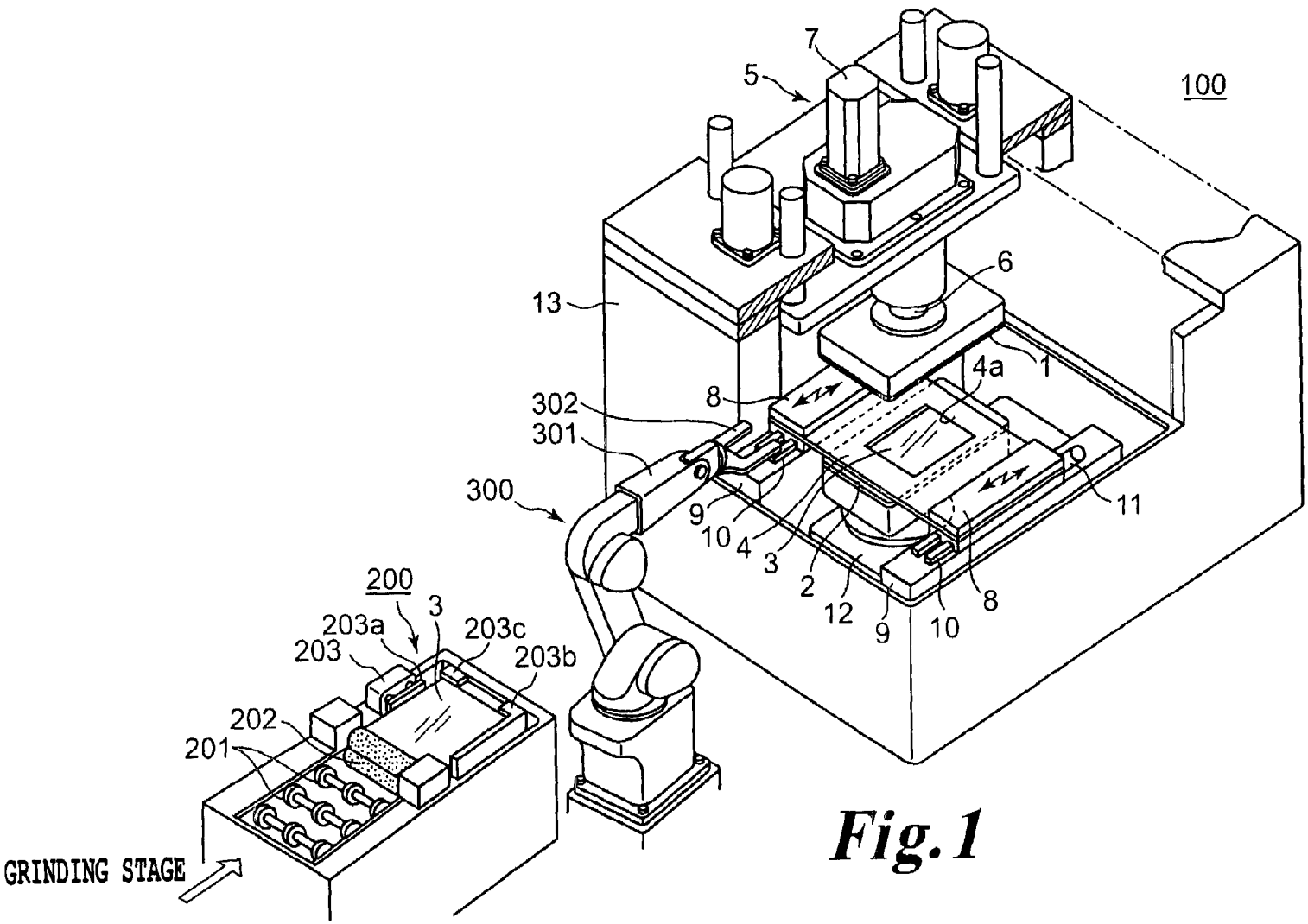
FIG. 1 is a perspective view of a double-sided polishing apparatus for a rectangular substrate.

Referring now to the drawings, wherein like reference numerals designate identical or corresponding parts throughout the several views, in the non-limiting embodiment shown in FIG. 1, 100 is a double-sided polishing equipment for a rectangular substrate, 1 is an upper rectangular polishing pad, 2 is a lower eccentric rectangular polishing pad, 3 is a rectangular substrate, 4 is a carrier, 5 is a polishing head, 6 is a spindle, 7 is an air cylinder, 8 is a carrier transfer mechanism, 9 is supporting base, 10 is a guide rail, 11 is a small servo-motor, 12 is a base, and 13 is wall material. Further, 200 is an alignment device for a rectangular substrate, 201 is a roll conveyor, 202 is a roll brush, 203 is a positioning mechanism, 203*a* is a push bar, and 203*b* and 203*c* are positioning guides. Additionally 300 is a robot for transferring the rectangular substrate, 301 is an arm, and 302 is a vacuum contact hand.

As shown in the non-limiting embodiment of FIG. 1 the rectangular substrate 3 glides on the roll conveyor 201 of the alignment device 200, and passes between roll brushes 202. Then, the right-hand edge thereof as shown in FIG. 1 comes into contact with guides 203*b* and 203*c* of the positioning mechanism 203, thereby pushing the push bar 203*a* forward. The rear edge of the rectangular substrate 3 is pushed forward until the corner of the right-hand edge is brought into contact with the guide 203*b*,so that the location coordinates of the rectangular substrate are determined in relation to the conveyor robot 300. When the vacuum contact hand 302 of the robot for transferring the substrate 300 absorbs the rectangular substrate 3, the push bar 203*a* will move back.

Figure 2:
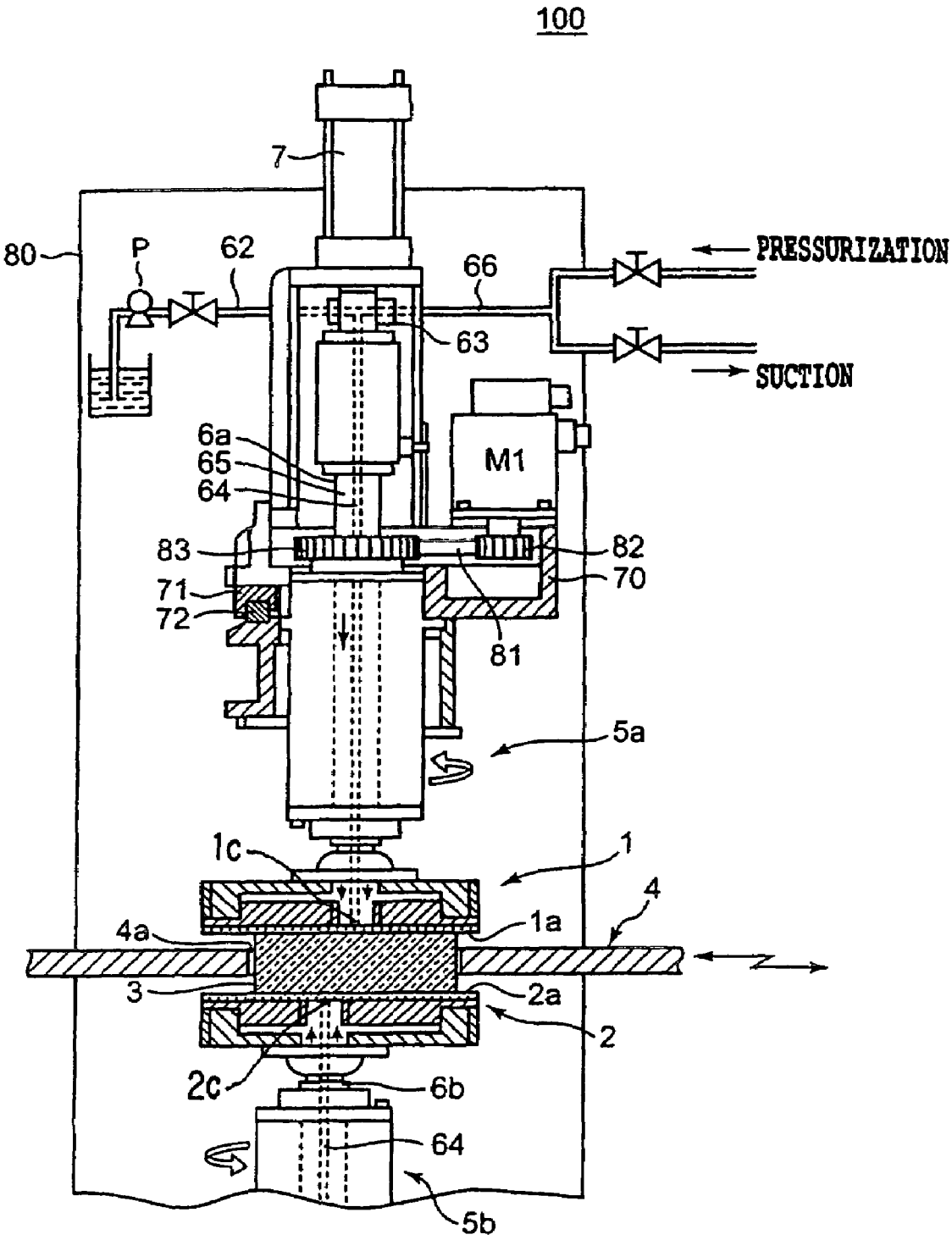
FIG. 2 is a cross-sectional view of a partially notched polishing head of the double-sided polishing equipment.

On polishing heads 5*a* and 5*b* of the double-sided polishing equipment 100 shown in FIG. 2, the eccentric rectangular polishing pads 1 and 2, where polishing cloth 1*a*, 2*a* is applied on the surface of the disc-shaped base, are placed at upper and lower positions, between which the rectangular substrate 3 is held by a carrier 4, with its polishing surfaces 1*b* and 2*b* placed parallel to each other. Centers of rotational axes 1*c* and 2*c* are placed so as to not be aligned with each other. The eccentric rectangular polishing pads 1 and 2 are supported by axes at hollow spindles (rotational axes) 6*a* and 6*b*. The polishing agent is supplied from a pump P to a tube 64 provided within hollow rotational axes 6*a* and 6*b* via a tube 62 and a rotary joint 63 in order to moisten the polishing cloth 1*a* and 1*b* of the polishing pads 1 and 2. The polishing pads are supported by a fitting frame 70. A slider 71 provided at the lower part of the fitting frame can move back and forth along a guide rail 72 provided on a column 80 so as to push forward or pull back the polishing pad 1 in a direction perpendicular to the lateral direction of the carrier 4.

The hollow spindles 6*a* and 6*b* can be rotated in opposite directions from each other at a particular rotation rate, such as 10–180 RPM, by a rotary drive including a motor M1, a pulley 82, and gears 81 and 83, etc. Other configurations to cause rotation are possible.

Pressurized air is supplied to a space 65 between inner chambers of hollow spindles 6*a* and 6*b* and the tube 64 via a tube 66 connected to a rotary joint 63 by a compressor that is not shown in the drawing. Air in the space 65 is discharged by means of a vacuum pump that is not shown in the drawing.

Before the polishing process, spacing between (original positions of) eccentric rectangular polishing pads 1 and 2 is adjusted depending on the thickness of the rectangular substrate 3. Preferably, the eccentric rectangular polishing pads 1 and 2 have dimensions 1.3 to 2.0 times that of the rectangular substrate to be polished and are homologous in shape of the substrate.

As materials of polishing cloth 1*a* and 2*a*, polyurethane foam sheets containing diamond particles or polyamide fiber containing diamond particles, which is processed into non-woven material and solidified into a sheet by urethane prepolymer, is used.

As a polishing agent, water, ceria, alumina, diamond, or silica series polishing agent slurry are typically used. The polishing agent is preferably a ceria series polishing agent slurry for a glass substrate, a colloidal silica series slurry for a silicon substrate, and an alumina or diamond series slurry for a sapphire substrate, though this may be changed depending on the type of substrate to be polished.

The rectangular polishing pads 1 and 2 are supported at axes by the hollow spindles 6*a* and 6*b*, so their centers of rotational axes 1*c* and 2*c* are 10–80 mm away from the diagonal intersection (center). The pair of eccentric rectangular polishing pads 1 and 2 is arranged, with the polishing surfaces 1*a* and 2*a* placed in parallel, to be symmetrical around a point to the carrier 4. The distance between the centers of rotational axes 1*c* and 2*c* of the pair of eccentric rectangular polishing pads 1 and 2 is preferably from 20–160 mm. Preferably, the spindle axes 6*a* and 6*b* of the pair of eccentric rectangular polishing pads 1 and 2 rotate in opposite directions from each other, the rotational rate for each of the eccentric rectangular polishing pads 1 and 2 is 10–200 RPM, and the pressure of the eccentric rectangular polishing pads to be applied on the rectangular substrate 3 is 20–100 g/cm$^2$. While the rectangular substrate is being polished, the carrier 4 will intermittently oscillate laterally. The oscillation rate for the carrier 4 is preferably 80–200 cm/min., variation of oscillation is 25–100 mm, and oscillation cycle is 2 to 20 times/min. The polishing allowance for the rectangular substrate 3 is preferably 2–100 μm, although this will vary depending on the material of the substrate and the application thereof. Although rectangular is used to describe the polishing pads 1 and 2, other shapes such as oval, circular, polygonal with more or fewer than four sides, for example, are sometimes used. Thus, the invention is not limited to rectangular polishing pads.

Figure 4:
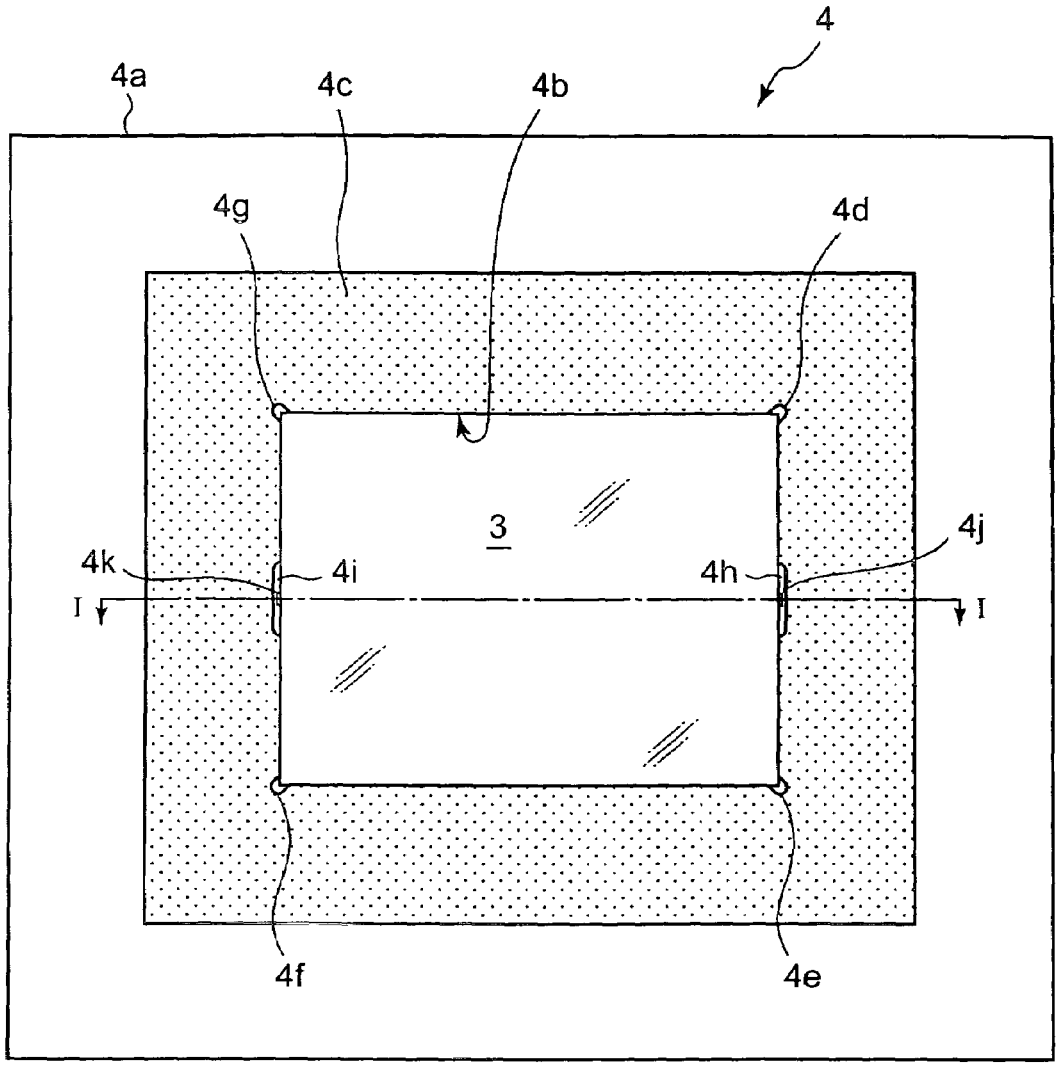
FIG. 4 is a plan view of the carrier.
Figure 5:
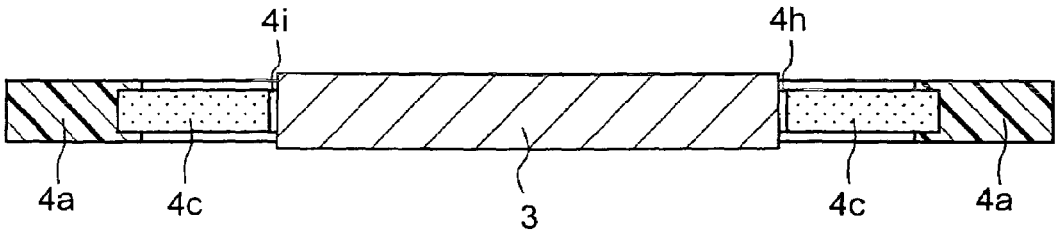
FIG. 5 is a cross-sectional view of the carrier holding a rectangular substrate.

As shown in FIGS. 4 and 5, the carrier 4 has a resin flexibility retention material (inner periphery) 4*c*, where a pocket for accommodating a rectangular substrate 4*b* is provided at the center within a rectangular metal carrier frame (outer perimeter) 4*a*, and runouts 4*d*, 4*e*, 4*f*, and 4*g* at the four corners of the pocket accommodate a rectangular substrate, which come into contact with the rectangular substrate 3 of this resin flexibility retention material to avoid contact with the corners of the rectangular substrate, as well as runouts 4*h* and 4*i* in the vicinity of a crystal liquid injection seal 4*j* and a crystal liquid suction seal 4*k* of the rectangular substrate. When the rectangular substrate has a dimension of 193.4 mm vertically and 256.6 mm horizontally, runouts at the corners 4*d*, 4*e*, 4*f* and 4*g* typically have a 3.5 mm radius around corners of the rectangular substrate, and are arranged so that dimensions of the runouts 4*h* and 4*i* in the vicinity of the crystal liquid injection seal are 3 mm in width and 30 mm long. The flexibility retention material 4*c* is typically is more flexible than the metal carrier frame 4*a*.

A metallic carrier frame 4*a* is typically made of stainless steel, aluminum, cast iron, or brass, etc. The resin flexibility retention material 4*c* is typically made of glass fiber-reinforced epoxy resin, glass fiber-reinforced aramid resin, or glass fiber-reinforced polyimide resin, etc. Other materials may be used.

For the carrier 4 held by a carrier transfer mechanism 8 at its front and rear edges, a screw actuator (not shown) driven by a small servo motor 11 drives this carrier transfer mechanism 8 to rotate the same, and the carrier transfer mechanism 8 slides along a guide rail 10. In the carrier 4, there are one or more pockets 4*a* that are slightly larger than the outer shape of the rectangular substrate 3, which are at the center in a widthwise direction and placed at predetermined intervals of 0.5 to 1 mm in a lengthwise direction. A flexible rubber plate 4*b* may be provided within the pocket 4*a*. In order for both sides of the substrate 3 to protrude from both sides of the carrier 4 by more than the amount of polishing allowance when the rectangular substrate 3 is engaged in the pocket 4*a*, the carrier 4 is thinner than the rectangular substrate 3.

Figure 3:
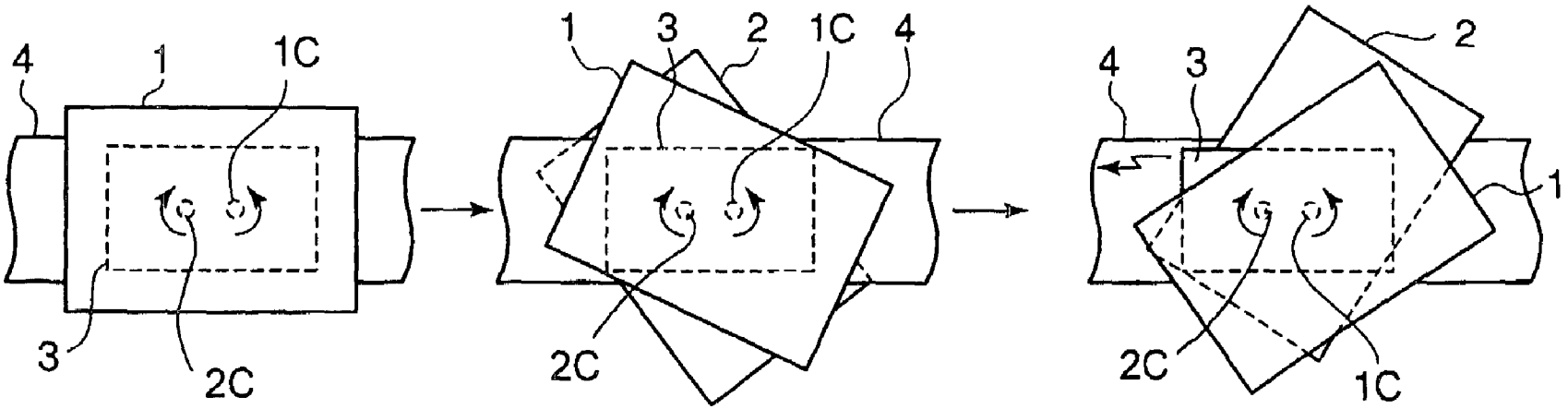
FIG. 3 is a plan view illustrating movement of a rectangular substrate and eccentric rectangular polishing pads while both sides of the rectangular substrate are being polished.

As shown in FIG. 3, while the carrier 4 intermittently oscillates laterally, the eccentric rectangular polishing pads 1 and 2 rotating around the centers of rotational axes 1*c* and 2*c* are caused to rotate in opposite directions from each other so as to polish both sides of the rectangular substrate 3 at the same time. As a result, this prevents the polishing cloth 1*a* and 2*a* of the eccentric rectangular polishing pads from wearing out locally, which extends the lifespan of the rectangular polishing pads and also prevents the planarized surface from deforming due to worn eccentric rectangular polishing pads, which improves the level of planarization on the rectangular substrate 3 as well as the consistency in substrate thickness.

At the point of beginning polishing, the spacing between the eccentric rectangular polishing pads 1 and 2 is preferably set slightly larger—for example, by about 0.05 mm to 0.1 mm—than the thickness of the rectangular substrate 3 to be held by the carrier 4. The thickness of material removed from the rectangular substrate 3 by polishing is adjusted by lifting and lowering an air cylinder 7. Once the rectangular substrate 3 is polished by the specified amount, the eccentric rectangular polishing pads 1 and 2 are removed from the carrier 4.

In order to efficiently polish the rectangular substrate, a plurality of double-sided polishing equipment 100 shown in FIG. 1 may be arranged in parallel. Such double-sided polishing equipment 100 can polish with different polishing pads and under different polishing conditions—for example, rough polish and finishing polish, or rough polish, middle polish, and precision finishing polish. As a matter of course, the elastic modulus of the polishing cloth for eccentric rectangular polishing pads and the roughness and amount of diamond particle content that are used at each polishing stage will vary, as will the polishing time and rotation rate of the eccentric rectangular polishing pads. In the case of three-stage polishing, for example, diamond abrasive grain of Nos. 100 to 325 is used as the diamond abrasive grain of the eccentric rectangular rough polishing pads, Nos. 600 to 2000 is for the diamond abrasive grain of middle finish polishing pads, and Nos. 3000 to 8000 is for the diamond abrasive grain of precision finish polishing pads.

For a two-step polishing stage, the polishing allowance for rough polishing is preferably 60% to 95% of the entire allowance in order to complete polishing quickly while ensuring a consistent polishing speed without causing surface defects such as cracks on the glass surface and is more preferably 75% to 85%. For the three-step polishing stage, the proportion of the amount of thickness to be polished by each step to the entire thickness to be polished is preferably 60% to 85% by rough polishing, 35% to 13% by middle polishing, and 5% to 2% by precision finishing polishing. For example, in order to polish both sides of a 0.60-mm-thick rectangular glass plate for LCD by 50 μm to obtain a 0.5-mm-thick rectangular glass substrate for LCD, for the two-step polishing stage, rough polishing should have a thickness of 0.52 mm. For the three-step polishing stage, rough polishing should have a thickness of 0.53 mm, middle finish polishing should be 0.502 mm, and precision finish polishing should be 0.500 mm.

For a rectangular substrate 3, a glass substrate such as a soda lime silica series glass, a boric acid series glass, an aluminosilicate glass, an alumino boric acid series glass, a non-alkali low-expansion glass, high strain point, high-expansion silicate glass, crystallized glass, etc., or a rectangular substrate such as a quartz substrate, a sapphire substrate, a GaAs substrate, or a silicon substrate, etc., is the substrate to be polished.

With a method for polishing both sides of a glass laminate for LCD panel by oscillating it laterally with a pair of eccentric rectangular polishing pads of the present invention, a glass laminate for LCD with improved consistency in thickness can be obtained.

Although certain embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

The invention claimed is:

1. A double-sided polishing equipment configured to polish a rectangular substrate, comprising:

a carrier having a pocket configured to accommodate a rectangular substrate;

a lateral linear moving mechanism configured to move the carrier;

first and second polishing pads with first and second offset rotational axes, respectively, the first and second offset rotational axes being offset from each other and from centers of the polishing pads, polishing surfaces of the first and second polishing pads being parallel;

an elevating mechanism coupled to at least one of the polishing pads;

first and second rotary drive mechanisms coupled to each of the first and second polishing pads, respectively, and configured to rotate the first and second polishing pads about the first and second offset rotational axes, respectively; and a polishing agent supplying device configured to supply polishing agent to a plane where a rectangular substrate that is accommodated in the pocket to accommodate the rectangular substrate comes into contact with the polishing pads.

2. The double-sided polishing equipment of claim 1, wherein the offset axes of rotation of the polishing pads are offset from each other by a distance from 20–160 mm.

3. The double-sided polishing equipment of claim 1, wherein the rotary drive mechanisms are configured to rotate the polishing pads in opposite directions.

4. The double-sided polishing equipment of claim 1, wherein each of the rotary drive mechanisms is configured to rotate the polishing pads at a rotational speed of 10–200 RPM.

5. The double-sided polishing equipment of claim 1, wherein the elevating mechanism is configured to apply a pressure of from 20 to 100 g/cm$^2$ to the substrate via the polishing pads.

6. The double-sided polishing equipment of claim 1, wherein the polishing pads are rectangular.

7. The double-sided polishing equipment of claim 1, wherein the polishing pads have dimensions from 1.3 to 2.0 times that of the rectangular substrate and have a shape homologous to the rectangular substrate.

8. The double-sided polishing equipment of claim 1, wherein the first and second polishing pads are supported by hollow spindles such that the offset rotational axes of the first and second polishing pads are from 10 to 80 mm away from a diagonal intersection of corners of the rectangular substrate.

9. The double-sided polishing equipment of claim 1, wherein the first and second polishing pads are arranged symmetrically around a midpoint of the carrier.

10. The double-sided polishing equipment of claim 1, wherein the carrier is comprised of a first material and a second material, the first material forming an outer perimeter of the carrier, and the second material forming an inner periphery of the carrier, the first material being stiffer than the second material.

11. The double-sided polishing equipment of claim 10, wherein the first material has a first thickness, and the second material has a second thickness less than the first thickness, and the first and second thicknesses are both less than a thickness of the rectangular substrate.

12. The double-sided polishing equipment of claim 1, wherein the pocket comprises runouts in each of four corners of the pocket.

13. The double-sided polishing equipment of claim 1, wherein the pocket comprises runouts along two interior straight edges of the pocket.

14. A method of polishing two sides of a rectangular substrate simultaneously, comprising:

holding the rectangular substrate within a pocket of a carrier;

passing the substrate between a pair of polishing pads with parallel polishing surfaces rotating in opposite directions on offset axes of rotation so as to polish two sides of the substrate, the offset axes of rotation being offset from each other and from centers of the polishing pads; and keeping the rectangular substrate on the polishing pads for a certain length of time and oscillating the carrier laterally and intermittently while polishing the rectangular substrate.

15. The method of claim 14, wherein the polishing comprises:

rough polishing removing 60% to 95% of an amount of material to be removed from the rectangular substrate; and precision polishing removing 5% to 40% of the material to be removed.

16. The method of claim 15, wherein the rough polishing removes 75% to 85% of the material.

17. The method of claim 14, wherein the polishing further comprises:

rough polishing removing 60% to 85% of material to be removed from the rectangular substrate;

middle polishing removing 13% to 35% of the material to be removed; and precision polishing removing 2% to 5% of the material.

18. The method of claim 14, further comprising applying a pressure of from 20 to 100 g/cm$^2$ to the rectangular substrate via the polishing pads.

19. The method of claim 14, further comprising rotating each polishing pad at a rotational speed of 10 to 180 RPM.

20. The method of claim 14, wherein the intermittent oscillation occurs 2 to 20 times per minute.

* * * * *